US007500373B2

(12) United States Patent
Quell

(10) Patent No.: US 7,500,373 B2
(45) Date of Patent: Mar. 10, 2009

(54) FLANGING DEVICE AND FLANGING METHOD WITH COMPONENT PROTECTION

(75) Inventor: Ewald Quell, Fulda-Sickels (DE)

(73) Assignee: EDAG GmbH & Co. KGaA (DE)

( * ) Notice: Subject to any disclaimer, the term of this patent is extended or adjusted under 35 U.S.C. 154(b) by 331 days.

(21) Appl. No.: 11/234,628

(22) Filed: Sep. 23, 2005

(65) Prior Publication Data

US 2006/0070418 A1 Apr. 6, 2006

(30) Foreign Application Priority Data

Sep. 24, 2004 (DE) ..... 10 2004 046 432
Apr. 13, 2005 (DE) ..... 20 2005 005 880

(51) Int. Cl.
*B21D 7/02* (2006.01)
*B21D 9/08* (2006.01)
*B23P 11/00* (2006.01)

(52) U.S. Cl. ..... 72/214; 72/212; 29/243.58

(58) Field of Classification Search ..... 72/211, 72/178, 212, 213, 214, 210; 29/243.5, 243.58, 29/243.57

See application file for complete search history.

(56) References Cited

U.S. PATENT DOCUMENTS 3,015,293 A * 1/1962 Parham ..... 29/509
4,398,334 A * 8/1983 Kovalevich ..... 29/243.5
4,472,867 A * 9/1984 Wivinis ..... 29/243.5
4,996,756 A * 3/1991 Bright et al. ..... 29/243.58
5,189,784 A * 3/1993 Welty ..... 29/796
5,669,260 A 9/1997 Stampfl et al.
5,784,915 A * 7/1998 Allemann et al. ..... 72/211
5,875,670 A * 3/1999 Stojkovski et al. ..... 72/211
6,477,879 B1 * 11/2002 Sawa ..... 72/220
7,017,268 B2 * 3/2006 Lang ..... 29/888.3
7,152,292 B2 * 12/2006 Quell et al. ..... 29/243.5

FOREIGN PATENT DOCUMENTS

| | | |
|---|---|---|
| DE | 198 37 792 | 6/1999 |
| DE | 100 12 274 C1 | 9/2001 |
| DE | 101 51 013 | 4/2003 |
| EP | 08 02 001 | 10/1997 |
| EP | 1 447 155 A1 | 8/2004 |
| JP | 07-060370 | 3/1995 |
| JP | 2003-103325 | 4/2003 |

OTHER PUBLICATIONS

Munchen, den Feb. 15, 2005; thr Zeichen: ed-77; Aktenzelchen: 10 2004 046 432.4.

* cited by examiner

*Primary Examiner*—Dana Ross
*Assistant Examiner*—Teresa Bonk
(74) *Attorney, Agent, or Firm*—RatnerPrestia

(57) ABSTRACT

A flanging device for roll-flanging a rim of a component includes a flanging head, a first flanging roller which is mounted by the flanging head and can be rolled off on the rim during roll-flanging, and a second flanging roller which is mounted by the flanging head and forms a counter pressure roller for the first flanging roller, the flanging device including a stable protective structure which is or can be fastened to the component and forms a rolling surface for one of the flanging rollers or supports a rolling surface.

33 Claims, 5 Drawing Sheets

FLANGING DEVICE AND FLANGING METHOD WITH COMPONENT PROTECTION

RELATED APPLICATIONS

Pursuant to 35 U.S.C. § 119, this application claims priority to German Patent Application No. 10 2004 046 432.4, filed Sep. 24, 2004, and to German Utility Application No. 20 2005 005 880.7, filed Apr. 13, 2005, the contents of both applications being incorporated by reference herein.

FIELD OF THE INVENTION

The invention relates to a flanging device for roll-flanging a rim of a component or other work piece along a flanging edge, and to a flanging method.

BACKGROUND OF THE INVENTION

The situation presented, in which an outer part of the body has to be connected to an inner part by hemming, arises for example in the case of wheel arches of vehicle bodies. The outer shell of the body has a circular arced, preferably semi-circular section, on the rim of which the so-called wheel arch is fastened on the inner side of the body. The problem here is that the outer side of the outer shell should not be deformed or at least deformed as little as possible, i.e. must not for example receive any dents or scratches, since these would be immediately visible when the outer shell is subsequently painted, and would spoil the aesthetic effect which the vehicle body is intended to impart.

In principle, this therefore prohibits using hemming device comprising pressing and counter pressure rollers, since the counter pressure roller would then run along the outer side of the outer shell and could deform it. The solutions known hitherto get by using sliders which are moved radially outwards behind the rim of the outer shell, with respect to the wheel section, and thus turn it inwards. Since a counter pressure is omitted here, the quality of the hem is not always satisfactory. Moreover, this is relatively involved equipment which only caters specifically for the body of one type of vehicle in each case, which makes using it in production facilities in which different types of body are built problematic.

SUMMARY OF THE INVENTION

The invention relates to a flanging device for roll-flanging a rim of a component or other work piece along a flanging edge, and to a flanging method. The flanging device preferably forms a hemming device for producing a hem connection. The component is preferably a body part, as such or already assembled. The invention is then particularly advantageous if the body part forms a viewed area, for example an outer part of the body, in the subsequent finished product, preferably a vehicle.

The invention preferably relates to a device for hemming the rim of a first body part which preferably forms an outer side of a body, wherein the rim of a second body part which for example forms an inner part of the body lies in the hem slot of the first body part. The device comprises a flanging head with at least one counter pressure roller supported on the outer side of the first body part and preferably at least two pressing rollers which oppose the counter pressure roller or each oppose one counter pressure roller, for successively turning over the rim of the first body part.

It is an object of the invention to turn over the rim of a component, preferably vehicle a body part and in particular an outer metal sheet, using simple means, such that the component is not deformed. The device should also be configured such that it can be quickly adapted to different component shapes.

The invention relates to a flanging device comprising a flanging head, at least one first flanging roller and at least one second flanging roller which are each pivoted by the flanging head. In the case of roll-flanging, the first flanging roller forms a pressing roller which rolls off on a rim to be beaded, preferably a narrow rim strip of the component. The second flanging roller acts as a counter pressure roller for the first flanging roller, i.e. it takes up the force to be applied by the first flanging roller in order to bead the rim strip by for example 30° or 45°. In accordance with their respective function, the first flanging roller is referred to below as the pressing roller and the second flanging roller is referred to below as the counter pressure roller. The flanging head can in particular be fastened to one end of a robot arm which preferably exhibits all six degrees of freedom of movement, but at least exhibits the degrees of freedom required for the flanging process itself.

In accordance with the invention, the flanging device further includes a stable protective structure which can be fastened to the component or is fastened during roll-flanging. For the counter pressure roller, the protective structure either forms a rolling surface itself, on which the counter pressure roller rolls off during roll-flanging, or it only forms the rolling surface indirectly, by supporting a rolling surface on which the counter pressure roller directly rolls off. In the first case, an inner side of the protective structure abuts the component and is preferably shaped so as to be adapted to its surface. An outer side of the protective structure forms the rolling surface for the counter pressure roller. In the second case, the protective structure is arranged in the inner region of the flanging edge to be formed and abuts the inner side of the component, wherein the protective structure is preferably shaped so as to be adapted to the surface of the inner side. Because it is supported on the inner side, the component can itself form the rolling surface for the counter pressure roller in the second case and is nonetheless not deformed by the pressing counter pressure roller, or far less than without the support on the inner side.

If the protective structure forms the rolling surface itself, the counter pressure roller does not roll off directly on the component, but on the protective structure which preferably forms a sort of matrix which is adapted to the inner side of the outer contour of the component, such that even the smallest spatial configurations of the component can be exactly copied and deformations need not be feared. The flanging head itself can be a standard type which can also be used for other flanging processes. Above all, this has the advantage that a number of different bodies can be processed for example on a production line for vehicle bodies, preferably automobile bodies. It is merely necessary to retain respectively adapted protective structures which can be initially placed onto the body or inserted in the inner region of the flanging edge, before the flanging process is started.

In preferred embodiments, the area of the protective structure with which the protective structure abuts the area to be protected is shaped so as to conform to said abutting area of the component, such that the protective structure and the component abut full-face.

The bodies and the protective structure preferably each have at least one marker which allows the protective strip to be placed in an exact fit on the rim to be flanged over. The at least one marker on the body can be a contour or edge which is inherently predefined, such as sections for doors, beams or the like. At least one hole can also be specifically introduced. In preferred embodiments, the protective structure possesses a centring element, preferably a positioning pin, and at least one stopper element which is used as a contour abutment. Alternatively, the protective structure can also be provided with just two centring elements, preferably positioning pins, or with just two stopper elements. Using such pairs of positioning means which co-operate with corresponding positioning means of the component or—in the assumed example—with the body, the protective structure is exactly positioned relative to the flanging edge when it abuts the abutting area of the component. In the alternative embodiment, in which the protective structure is arranged in the inner region of the flanging edge, a single positioning element—preferably a stopper element—can be sufficient for positioning.

In one development, the flanging head mounts a third flanging roller which forms another counter pressure roller for at least one of the first flanging roller and the second flanging roller in a flanging process. A closed flow of force may be obtained by means of such a third flanging roller. Such an embodiment is particularly advantageous for a protective structure arranged in the inner region of the flanging edge. The third flanging roller, acting as a suppressor, can also serve to fasten the protective structure. Thus, in particular in a protective structure arranged in the inner region of the flanging edge, an additional fastening can even be completely omitted. In principle, this also applies to a protective structure abutting on the outside.

In another development, a sensing element is fastened to or formed on the flanging head, preferably pivoted as a sensing roller, in addition to the at least two flanging rollers, and the protective structure forms a guiding path for the sensing element, preferably another rolling surface, which follows the course of the flanging edge. The sensing element, which is guided on the guiding path along the flanging edge in a flanging process, in turn guides the flanging head, enabling the expenditure which has to be made for controlling the movements of the flanging head, in particular the measuring expenditure, to be reduced. For roll-flanging along the flanging edge, it is in principle even possible to completely omit controlling or regulating on the basis of positional signals obtained by measurement. If the flanging head is guided along the flanging edge by means of a sensing element, by guiding the guiding element on a guiding cam which is preferably formed by the protective strip but could in principle for example also be formed by the flanging edge itself, the flanging head is preferably mounted such that it can move back and forth in a direction pointing at least substantially normally with respect to the guiding path, preferably against an elastic restoring force. The elastic restoring force can expediently be a pneumatic force.

Advantageously, a sensor, preferably a distance sensor, is provided. The sensor is preferably mounted on the flanging head or a platform to which the flanging head is fastened. By means of the sensor the distance between the flanging head and the component or the protective structure can be ascertained. The sensing element can be replaced by a distance sensor which operates without contact, by moving the distance sensor along the guiding path described with respect to the sensing element during roll-flanging, constantly measuring the distance without contact, and using the readings to regulate the movement of the flanging head. A 1D sensor is sufficient as the distance sensor.

In developments, a two-dimensional sensor is provided which operates without contact, i.e. a 2D sensor using which the position of the flanging head relative to the component, in particular its flanging edge, can be ascertained in a plane of view onto the component. The 2D sensor is preferably mounted on the flanging head or a platform to which the flanging head is fastened. In the preferred application—roll-flanging on a body part—the plane of view extends in the XZ plane of the usual co-ordinate system of vehicle bodies. This sensor system is only required, and in advantageous method embodiments also only used, to place the flanging head for roll-flanging on the flanging edge. If a mechanical sensing element or the distance sensor cited is not provided, the 2D sensor or another substitute sensor system, for example two 1D sensors, can also be used to regulate the movements of the flanging head during roll-flanging. Preferably, however, the 2D sensor system is provided in addition to the sensing element or distance sensor cited. Sensing and regulating in the XZ plane is particularly advantageous for hemming a so-called drop flange. If, however, it may be assumed that the components to be flanged always assume the position provided for roll-flanging with sufficient accuracy, and are themselves always shaped with sufficient accuracy, then a 2D sensor system can be omitted, since in this case, it is possible to rely on the fact that it is sufficient if the flanging head moves to a predefined position, for example a pre-programmed position. In the circumstances cited, the sensing element and the distance sensor can also be omitted.

The protective structure, or at least the part of it which forms the rolling surface or rolling surface support, is advantageously shaped in a moulding method and is in this sense preferably a moulded structure. The protective structure can be sufficiently pre-formed by moulding that, if the protective structure forms the rolling surface, the moulded piece ideally only needs the surface forming the rolling surface to be reworked. In general, however, other surface processing will also be necessary. Preferably, assembly points are thus provided on the protective structure after moulding, for example for the positioning elements of the positioning apparatus or as applicable for fastening elements of a fastening apparatus. Although, if strong enough, the protective structure can be made of plastic, it is preferably as cast metal structure made of a metal or metal alloy. In particular, it can be a grey cast iron structure. Alternatively, however, it would also be conceivable for the protective structure to be made of steel. Furthermore, it would also be conceivable to form the protective structure as a composite structure, for example with a rolling surface consisting of steel or a ceramic material and a bearer structure made of grey cast iron or plastic. A protective structure consisting entirely of a ceramic material is also not to be ruled out.

The flanging head preferably consists of a bearer which can be shifted relative to a holder and on which at least one counter pressure roller is mounted, and of a carriage held such that it can shift on the bearer and on which the at least one pressing roller, preferably at least two pressing rollers, is/are mounted at different approach angles, wherein an actuating apparatus is preferably provided between the bearer and the carriage and can be arrested or set such that it exerts a predetermined actuating force. In order to turn the rim over by a particular angle, a corresponding pressing roller is selected on the head and encloses the desired angle with a counter pressure roller. This pair of rollers is moved along the rim of the component, preferably a vehicle body, which is to be hemmed over, such that the rim is turned over by the desired angle. This process is repeated two or three times, wherein the turning-over angle becomes tighter and tighter, until the hem is finally closed or, if a hem connection is not being produced, the desired bending angle has been obtained.

When the rim is only partially turned over, the actuating apparatus is arrested such that the rim is set to the predefined angle, irrespective of the forces necessary for this. When completely closing a hem, by contrast, it is crucial that a particular force is exerted in order to pinch the rim of a second body part, lying in the hem slot. To this end, the actuating apparatus is preferably controlled such that it exerts a predetermined actuating force.

The bearer and the carriage guided on it are in turn mounted on a holder such that they can shift, the holder generally being connected to a robot arm which moves the holder in pre-calculated trajectories. In order to hem over a rim, the robot guides the flanging head along the rim, wherein the shifting bracket of the bearer on the holder enables an automatic equalisation perpendicular to the component. This also equalises tolerances with regard to the orientation of the component relative to a target pre-set which is known to the robot. It is therefore not necessary to separately and exactly detect the actual position of the component, preferably a metal body sheet.

The actuating apparatus is preferably a pneumatic cylinder, wherein the latter, when arrested, is charged with highly pressurised air, which all but amounts to being arrested. When performing a final hemming process, the pressure in the cylinder determines the forces exerted on the hem.

The flanging head is particularly simple to handle if a counter pressure roller is provided on the bearer for each of the pressing rollers on the carriage, since the head then merely needs to be re-orientated as a whole from flanging step to flanging step.

As mentioned above, it is possible for the bearer to be able to be freely shifted on the holder, within limits. However, in order that movements of the robot arm do not lead to jolting oscillations between the limits, a damper can be arranged between the bearer and the holder.

The invention further relates to a method such as has already been outlined above. Crucially, a protective structure is initially placed onto the component rim to be hemmed over or inserted into the inner region of the flanging edge and forms or supports a rolling surface for the counter pressure roller. Using a device in accordance with the invention, different component shapes can therefore be processed. It is merely necessary to retain a respectively compatible protective structure. The flanging head can remain unchanged; merely its control is advantageously adapted to the respective body, wherein the thickness of the protective structure should also be taken into account.

Furthermore, when partially turning over, the actuating apparatus of the flanging head is preferably arrested such that the bending angle predefined by the actuating angle is maintained during roll-flanging. When finally hemming, by contrast, a defined force is advantageously exerted which leads to the hem slot being optimally closed and generates sufficiently large clamping forces on the rim of the second component, lying in the hem slot.

Wherever the invention has been explained above with respect to a hemming device, these embodiments also apply analogously to a flanging device, i.e. to a device by means of which a hem connection can be formed but which can also serve to merely bead the component rim by a predetermined angle. During flanging or hemming, the rim can be completely, i.e. parallel to the opposing component region, or only partially beaded.

In addition to the device itself, the subject of the invention also includes a method which can in particular be performed using the flanging device. This is a method for roll-flanging a component along a flanging edge, on one side of which the component forms a viewed area or in any event an area which is to be treated gently, and on the other side of which the component forms a rim, preferably a rim strip, which is to be flanged around the flanging edge. In accordance with the method, the rim is flanged around the flanging edge by means of a pressing roller which rolls off on the rim and a counter pressure roller, wherein the counter pressure roller does not roll off directly on the component but rather on a protective structure protecting the component, in order to take up the bending force exerted by the pressing roller on the rim. In the alternative embodiment, the counter pressure roller can roll off directly on the component, as applicable also on another structure placed onto the component, but the component is supported by the protective structure on its inner side facing away from the counter pressure roller. In the case of the protective structure being arranged in the inner region of the flanging edge, said protective structure can in principle support the rim of the component and in this way, while not taking up the force exerted by the pressing roller for beading, can nonetheless support the rim acting as a rolling surface for the pressing roller. The protective structure is preferably fastened to the component or to a structure, the fixed constituent of which is formed by the component, either using an additional fastening apparatus or by an additional roller acting as a suppressor, or both in combination. As applicable, the pressing roller and counter pressure roller can already form the fastening apparatus together with the component. The protective structure is preferably shaped to follow the course of the flanging edge, at least on a rim facing the flanging edge. In principle, however, the protective structure could also be shaped differently, which however could require a larger flanging head, since the latter encompasses the flanging edge and the protective structure in the region of the pressing roller and the counter pressure roller co-operating with it. Advantageously, the protective structure is at least substantially as narrow as the counter pressure roller which rolls off directly on the protective strip or the rolling surface supported by it.

The subject of the invention also includes a method in which the work piece is beaded by a first angle by means of a first pair of rollers consisting of a pressing roller and a counter roller and is further beaded by a second angle by means of a second pair of rollers consisting of a pressing roller and a counter roller, wherein the rollers of the first pair of rollers in the first flanging step form a more rigid arrangement than the second pair of rollers in the second flanging step. In the first flanging step, the rollers of the first pair of rollers are preferably arrested with respect to each other, such that their rotational axes can be regarded as axes which are fixed with respect to each other. In the second flanging step, the rollers of the second pair of rollers are preferably resiliently mounted with respect to each other, such that the rotational axes of these rollers can move resiliently with respect to each other. As applicable, they are also mounted such that they are only damped with respect to each other or such that they are resilient and damped with respect to each other. In the second flanging step, the rim is preferably completely beaded, such that it comes to rest at least substantially parallel to an area of the work piece opposing across the flanging edge, as is for example usual in hem connections. Other flanging steps can be provided between the first flanging step and the second flanging step, preferably by means of yet another or a number of other pairs of rollers. One or more other flanging steps can also precede the first flanging step. The two flanging steps can also be performed in the same run, if the first pair of rollers and the second pair of rollers form a tandem, i.e. if the second pair of rollers follows the first pair of rollers.

In preferred embodiments, the protective strip is shaped and fastened to the work piece or to a structure including the work piece, such that no "air" remains between the surface to be protected and the protective strip. This prevents the work piece from giving way relative to the protective structure during roll-flanging. The protective structure can abut the surface in a line along the length of the flanging edge. More preferably, however, it abuts full-face along the width of the counter roller or along the width of the rolling surface formed by the protective structure, i.e. the protective structure is shaped so as to conform to the area to be protected or supported.

Advantageous features are also described in the sub-claims and combinations of the same. The features disclosed by the sub-claims and the embodiments described above also complement each other reciprocally. The flanging devices described in accordance with the present invention, of claims 20 and 25 and methods which may be performed using them, are preferably used in combination with the protective structure, but are also advantageous without the protective structure.

BRIEF DESCRIPTION OF THE DRAWINGS

An example embodiment of the invention is explained below on the basis of figures. Features disclosed by the example embodiment, each individually and in any combination, advantageously develop the subjects of the claims and the embodiments described above. Therefore, the foregoing summary and the following description will be better understood in conjunction with the drawing figures, in which:

DETAILED DESCRIPTION

Figure 1:
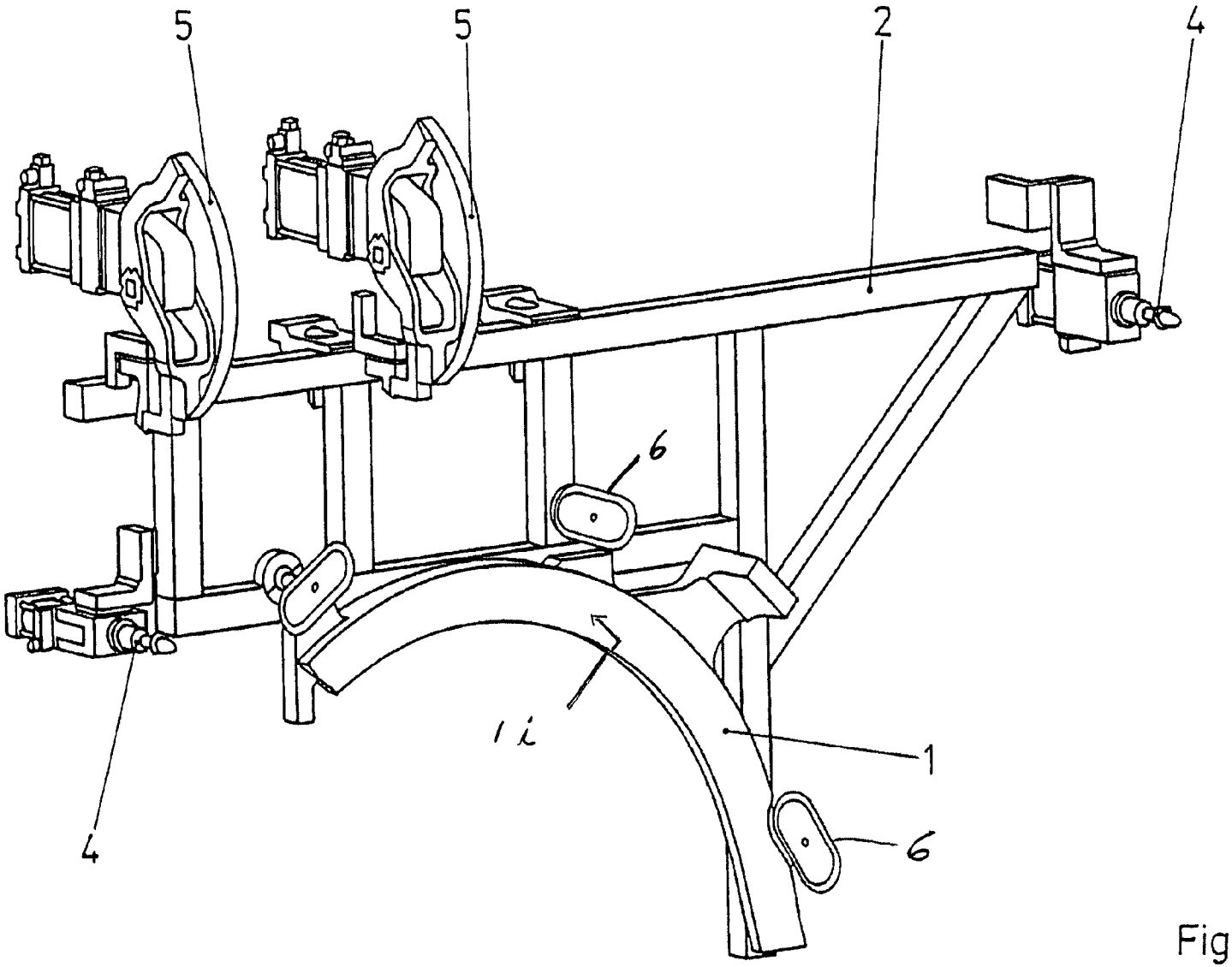
FIG. 1 is a perspective view of a protective strip comprising a holding structure in accordance with the present invention.

FIG. 1 shows a protective strip 1 in a framework 2 in accordance with the present invention. As will be recognised, the protective strip 1 follows the course of a wheel section. Its inner side 1*i*, visible in the figure, exhibits a contour which copies the desired outer contour of the body on the wheel arch, as a negative. The outer contour is generally in no way smooth, but is often provided with different facets and vertical structures, in order to obtain a particular aesthetic effect and/or a smooth transition to the adjacent body portions. On no account should this contouring be breached.

The framework 2 comprises a number of markers in the form of positioning pins 4 which engage with corresponding holes in the body, whereby the protective strip 1 is definitively fixed with respect to the body. Mechanical clamps 5 hold the framework 2 and therefore the protective strip 1 clamped on the body.

The outer side of the protective strip 1 is smooth and forms a rolling surface 1*a* (FIG. 3) for a counter pressure roller of a flanging head.

Figure 2:
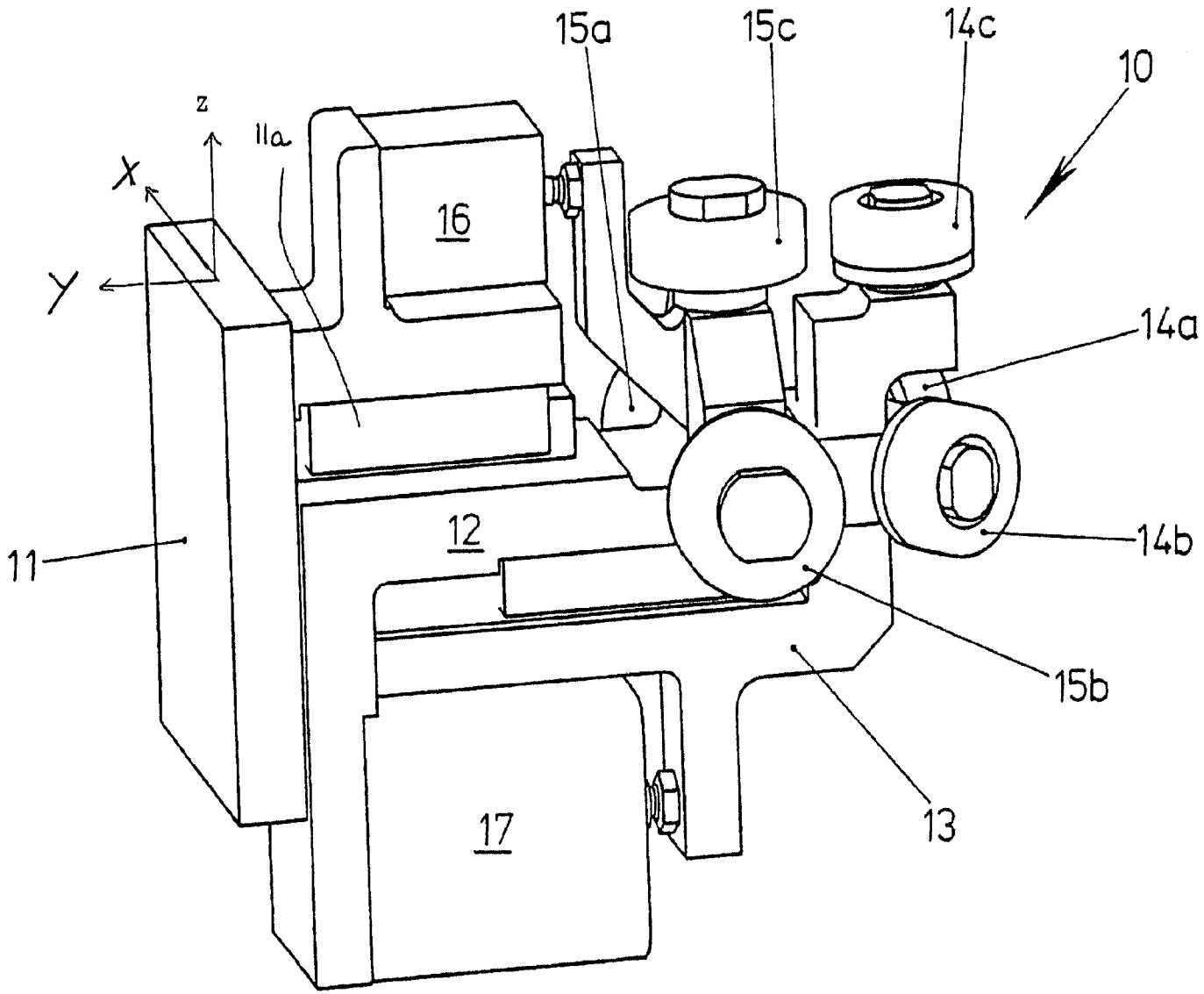
FIG. 2 is a perspective view of a flanging head.

Such a flanging head 10 is shown in FIG. 2. It consists of a holder 11, a bearer 12, a carriage 13, as well as three pressing rollers 14*a*, 14*b*, 14*c* and three counter pressure rollers 15*a*, 15*b*, 15*c*.

The bearer 12 is held such that it can move in a carriage guide 11*a* relative to the holder 11, wherein a damping apparatus 16 limits and simultaneously damps this movement. In any event, this ability to move the bearer 12 means that the holder 11 does not have to be moved along the rolling surface 1*a* exactly with regard to its transverse orientation; rather, an automatic equalisation perpendicular to the body, i.e. in the Y direction, results.

The pressing rollers 14*a, b, c* on the carriage 13 oppose the counter pressure rollers 15*a, b, c* on the bearer 12, wherein each pair a, b, c encloses a different angle. The hem is set to 90° using the pair a recognisable in the background, a hemming angle of 45° is obtained using the pair b recognisable in the foreground, and the hem is closed to form a hem slot using the pair c recognisable in the top of the figure. At this point, it may be noted that it is also possible to provide only one counter pressure roller, but that a revolver or other roller changer should then be provided on the carriage 13, in order to place the respectively compatible pressing roller opposite the one counter pressure roller. Yet other pairs of rollers can also be provided, in order to complete the beading in smaller angular increments.

The actuating apparatus 17 between the carriage 13 and the bearer 12 comprises a pneumatic cylinder which with can be charged with a high pressure, such that the carriage 13 is ultimately arrested on the bearer 12. This setting is selected if the pairs of rollers a and b are active.

When finally closing the hem using the pair of rollers c, a predefined pressure is exerted on the pneumatic cylinder, such that a particular actuating force or closing force is exerted when closing the hem.

Figure 3A:
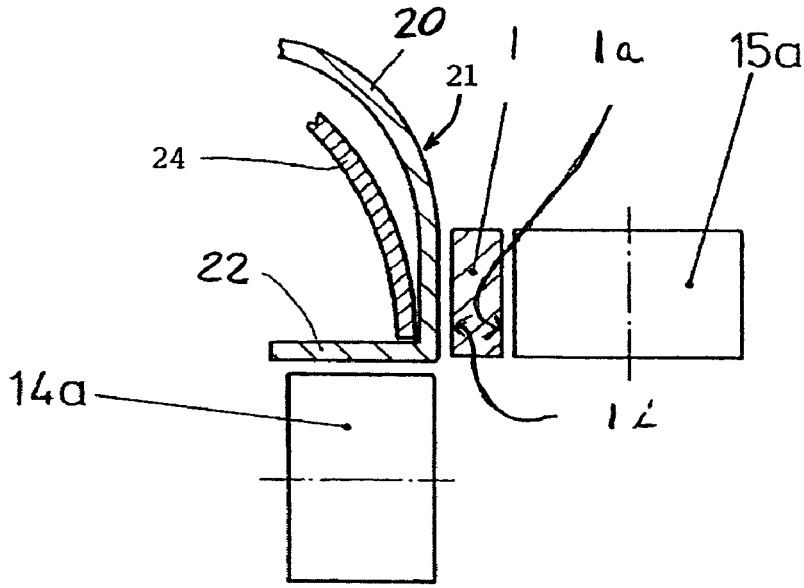
FIGS. 3*a*-3*c* are partially truncated schematic views illustrating different stages of a flanging process in accordance with the present invention.
Figure 3B:
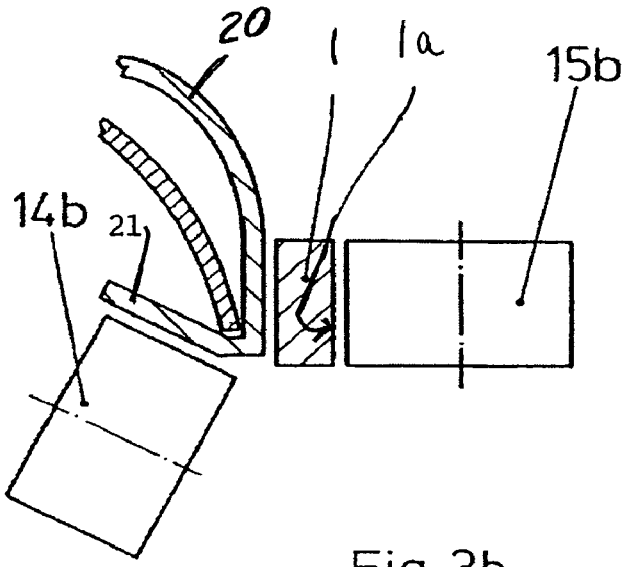
Figure 3C:
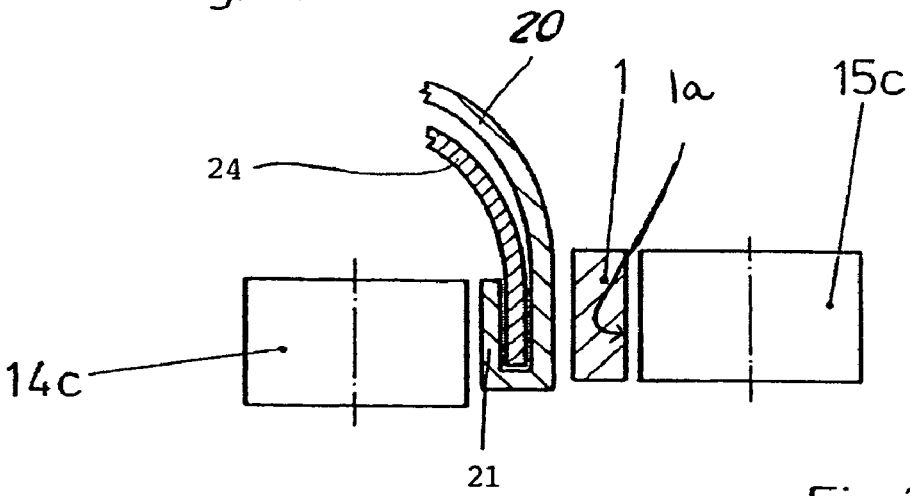

The successive hemming steps are shown in FIGS. 3*a*, 3*b* and 3*c*. Before roll-hemming, the body part 20 already exhibits a pre-formed hemming edge. On the one side of the hemming edge, the body part 20 forms a viewed area 21, and on the other side a rim strip 22 which is already beaded by an angle of for example 45° or 60°. The rim of a second body part 24 is inserted into the inner region of the flanging edge delineated by the viewed area 21 and the rim strip 22, said second body part 24 being fixedly connected to the body part 20 by the roll-hemming. The protective strip 1 and in particular its rolling surface 1*a* are just as wide as the counter pressure roller 15*a*. The inner side 1*i* of the protective strip 1 lies full-face against the viewed area 21 in the immediate vicinity of the hemming edge. In three flanging steps a, b and c, the rim strip 22 is further beaded successively by an angle predefined by the angular position of the pressing roller 14*a*, 14*b* or 14*c* being respectively used. In Step a (FIG. 3*a*), a hemming angle of 90° is set, and in Step b, an angle of about 45°. In these steps, a fixed spatial assignment of the counter pressure roller and the pressing roller is set.

In the subsequent Step c, the rim is closed, wherein the actuating force exerted is determined by the pressure in the actuating apparatus. This pinches the rim of the body part 24 in the hem slot formed.

Figure 4:
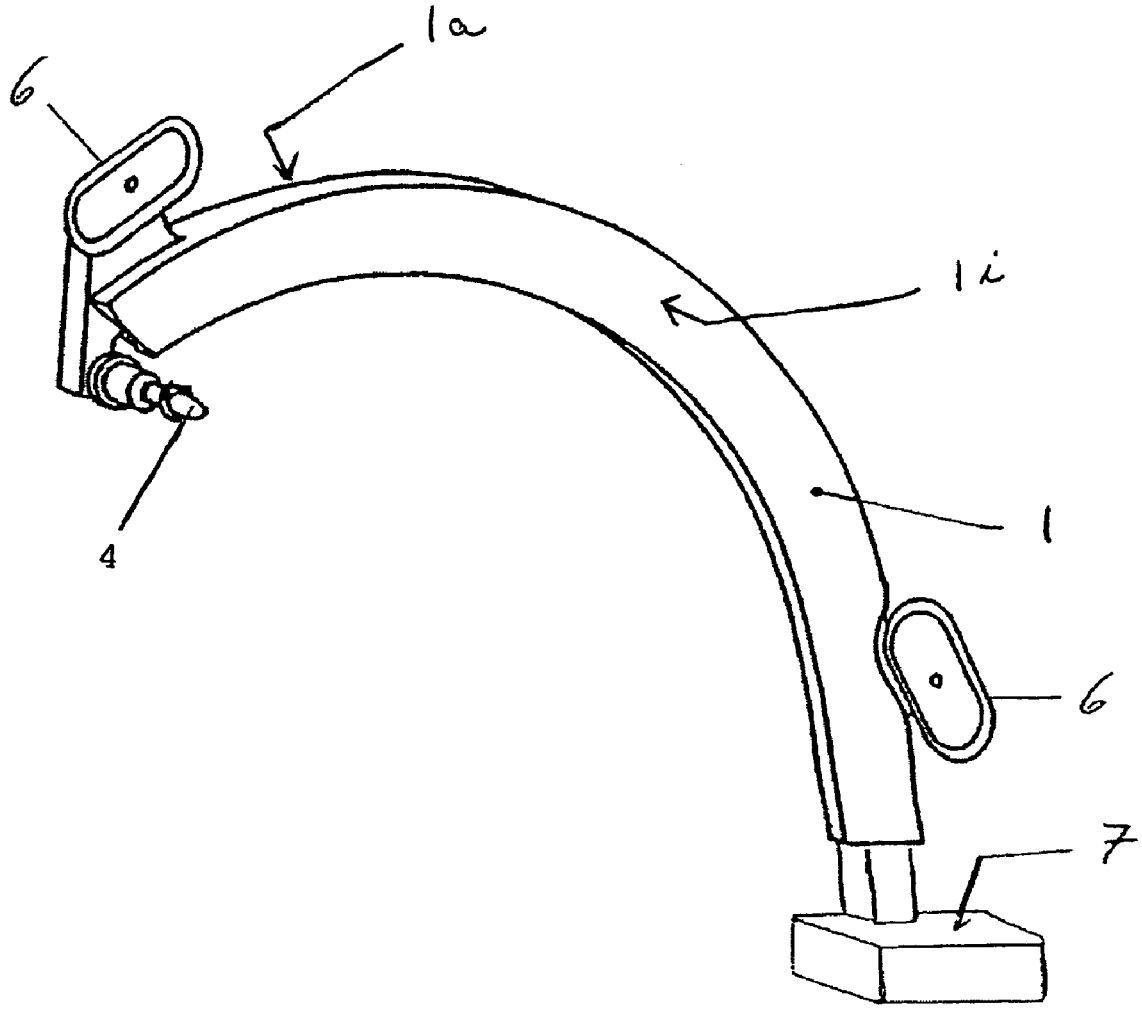
FIG. 4 is a perspective view of a protective strip comprising an integrated positioning and fastening apparatus in accordance with the present invention.

FIG. 4 shows an advantageously reduced protective strip 1, for which the framework 2 has been omitted. The suction apparatus 6 consists of two suckers arranged in the region of the two ends of the protective strip 1. Another sucker, or as applicable also a number of other suckers, can be arranged between the two suckers, following the course of the rolling surface 1*a*. The positioning pin 4 is furthermore arranged near the rolling surface 1*a* and likewise at one of the two ends of the protective strip 1. A stopper element 7 is arranged at the other end of the protective strip 1, either formed on it in one piece or preferably fastened to it, and in conjunction with the positioning pin 4 ensures that the protective strip 1 is positioned on the body part 20 in an exact fit. The stopper element 7 serves as a contour abutment. Thus, its area facing the protective strip 1 can for example form a stopper area for a lower edge of the body part 20. At least the part of the protective strip 1 which forms the rolling surface 1*a* is formed in one piece by moulding and can in particular consist of grey cast iron. The positioning pin 4 can be formed integrally with the protective strip 1 in the mould or can also be fastened to the moulded protective strip 1 only after moulding. The same applies to the stopper element 7 which, however, is preferably made of plastic and fastened to the moulded piece. For positioning and fastening, the positioning pin 4 is inserted into a hole provided on the body part 20 or on another part of the body. The protective strip 1 is then rotated about the pivot formed by the positioning pin 4 until the stopper element 7 abuts the counter contour of the body part 20 or another part of the body. The inner side 1*i* of the protective strip 1 is placed against the viewed area 21, either slightly pressed or already suctioned by the suction apparatus 6, and is then positioned relative to the flanging edge and fastened to the component 20. The suction apparatus 6 can be embodied to be active or passive, which moreover also applies to the suction apparatus 6 of FIG. 1. In its active embodiment, it can be charged with a partial vacuum via a conduit system. In its passive embodiment, it merely acts as an elastic suction cup which, however, can be ventilated in order to release the protective structure. In addition to the suction apparatus 6, one or more mechanical clamps can be attached to the protective structure 1. One or more mechanical clamps can also be provided instead of the suction apparatus 6.

Figure 5:
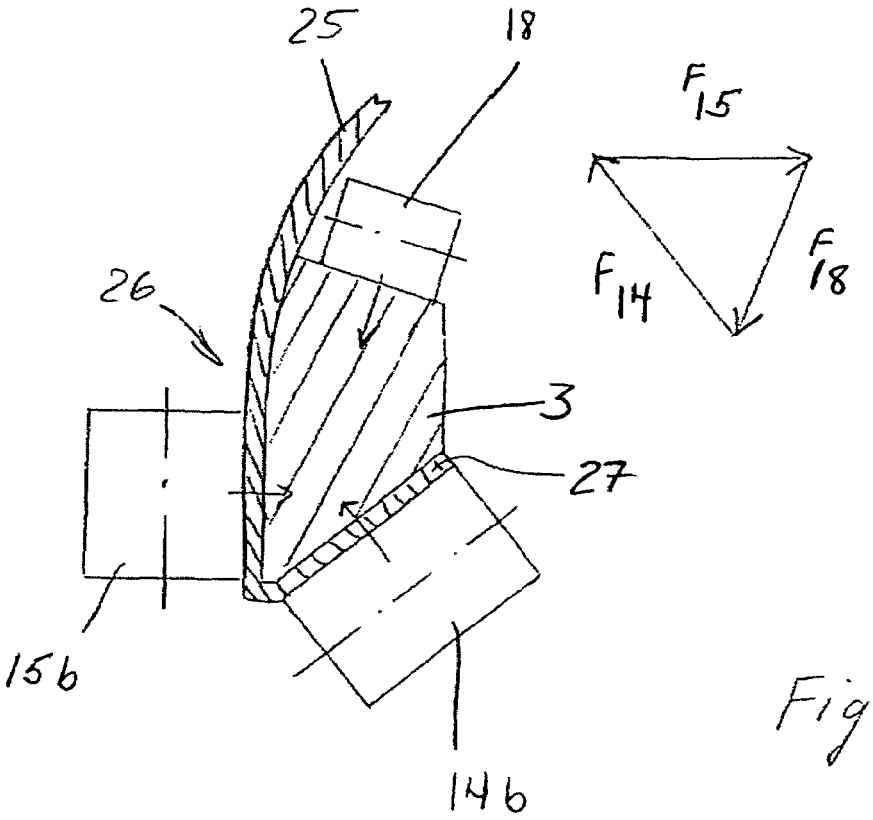
FIG. 5 is a partially truncated schematic view illustrating the use of an interior protective structure during a flanging step in accordance with the present invention.

FIG. 5 shows a flanging step in a flanging method, in which an interior protective structure 3 is used. The protective structure 3 is inserted into the inner region of the flanging edge and supports the viewed area 26 of a body part 25 which then serves directly as a rolling surface. The flanging head 10 is used. The counter pressure roller 15*b* rolls off directly on the viewed area 26, along the flanging edge. The viewed area 26 thus forms the rolling surface. This rolling surface, however, is supported from within, i.e. on the inner side of the viewed area 26, by the protective structure 3. The protective structure 3 takes up the force exerted by the counter pressure roller 15*b* during roll-flanging, such that the viewed area 26 cannot be deformed. The protective structure 3 comprises an abutting area which faces the counter pressure roller 15*b* and is shaped so as to conform to the inner side of the viewed area 26, such that it abuts full-face, i.e. faying. Furthermore, the protective structure 3 forms an abutting area for the pressing roller 15*b*, wherein this support is not received until directly after the rim strip 27 has been beaded. In this sense, the rim strip 27 also forms a rolling surface supported by the protective structure 3.

During roll-flanging as shown in FIG. 5, the rim of the component 25 is only beaded. A hem connection is not produced. The pair of rollers 14*b* and 15*b* performs the final flanging step, wherein the pressing roller 14*b* can be set resilient relative to the counter pressure roller 15*b* by means of the actuating apparatus 17.

In order to obtain a closed flow of force during roll-flanging, another counter pressure roller 18 which serves as a suppressor during roll-flanging can advantageously be pivoted on the flanging head 10 in addition to the pressing and counter pressure rollers already described, as in the example embodiment of FIG. 5. The protective structure 3 forms a rolling surface 3*f* for the counter pressure roller 18 on a side facing away from the pressing roller 14*b* and the counter pressure roller 15*b*, said rolling surface 3*f* being orientated with respect to the rollers 14*b* and 15*b* such that the forces $F_{14}$, $F_{15}$ and $F_{18}$ exerted by the three rollers 14*b*, 15*b* and 18 form a closed triangle of forces, as likewise indicated in FIG. 5.

If, using the interior protective strip 3, the rim strip 27 is not only to be beaded, but a hem connection to an interior body part is also to be produced, then the rim of the interior body part is arranged between the inner side of the viewed area 26 and the protective strip 3, such that two layers of material are situated between the protective strip 3 and the counter pressure roller 15*b*. For a strong hem connection, it is not absolutely necessary for the rim strip 27 to be completely beaded, i.e. placed onto the interior body part. The two body parts are preferably pre-jointed before roll-hemming, for example by means of spot welding or adhesion, wherein a full-face connection in the inner region is preferable to just a spot connection.

Figure 6:
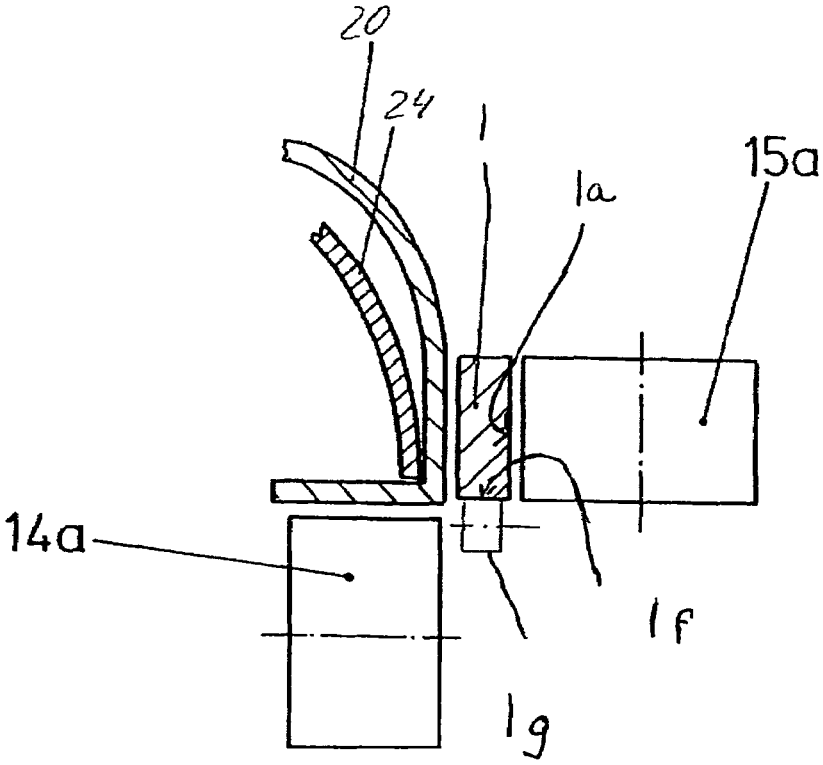
FIG. 6 is a partially truncated schematic view illustrating a flanging step using a modified flanging head and an exterior protective structure in accordance with the present invention.

FIG. 6 shows the hemming step of FIG. 3*a* in a modification. In said modification, a sensing roller 19 is pivoted on the flanging head 10 in addition to the pressing and counter pressure rollers 14*a*-15*c*. During hemming, the sensing roller 19 rolls off on a guiding path 1*f* of the protective structure 1. The flanging head 10 follows the movement of the rotational axis of the sensing roller 19 along the flanging edge and is thus guided by the sensing roller 19. In roll-flanging with an interior protective strip 3, the counter pressure roller 18 can analogously be used as a sensing roller guiding the flanging head 10. Using a sensing roller 19 or 18 reduces the measuring and regulating expenditure which has to be made for guiding the flanging head 10. The sensing roller 19, which could in principle be replaced by a sliding piece, is arranged between the rollers 14*b* and 15*b* and within the range of angles at which the rollers 14*b* and 15*b* encompass the flanging edge.

If the flanging head 10 possesses such a sensing roller 19 or 18, it is preferable if the flanging head 10 is pressed against the guiding path 1*f* or 3*f* by an elasticity force. The elasticity force is advantageously generated pneumatically. In one further development, the flanging head 10 can then be arranged such that it can move back and forth, preferably along the Z axis (FIG. 2), by means of another linear guide, for example by guiding the holder on a platform such that it can move in the Z direction or by additionally forming such a linear guide between the holder 11 and the rest of the flanging head 10. Another damping apparatus, comparable to the damping apparatus 16, would be provided for this optional other linear guide. Instead of a linear guide, a pivoting apparatus could for example also be provided. Only an ability to move normally with respect to the guiding cam 1*f* or 3*f* is necessary for pressing the sensing roller 19 or 18.

The sensing roller 19—and also the counter pressure roller 18 (FIG. 5), if the latter is only or also used to act as a sensing roller—can be replaced by a distance sensor which operates without contact and which can be arranged instead of the sensing roller 19 and/or roller 18, in order to scan the guiding path 1*f* or 3*f* without contact.

In the foregoing description, a preferred embodiment of the invention has been presented for the purpose of illustration and description. It is not intended to be exhaustive or to limit the invention to the precise form disclosed. Obvious modifications or variations are possible in light of the above teachings. The embodiment was chosen and described to provide the best illustration of the principals of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled.

What is claimed:

1. A flanging device for roll-flanging a rim of a component, said flanging device including:

a) a flanging head;

b) a first flanging roller which is mounted by the flanging head and can be rolled off on the rim during roll-flanging; and c) a second flanging roller which is mounted by the flanging head and forms a counter pressure roller for the first flanging roller;

wherein the flanging device includes a stable protective structure which is or can be fastened to the component and forms a rolling surface for one of the flanging rollers or supports a rolling surface, wherein the protective structure includes a fastening apparatus for fastening to the component, and wherein the fastening apparatus includes a suction apparatus comprising pneumatic suckers which are arranged spaced out from each other, following a flanging edge to be formed.

2. The flanging device according to claim 1, wherein the rolling surface is formed on an outer side of the protective structure and an inner side of the protective structure is adapted to a surface contour of the component which the protective structure abuts during roll-flanging.

3. The flanging device according to claim 1, wherein the protective structure for being inserted into an inner region of a flanging edge to be formed is adapted to the shape of an inner side of the component.

4. The flanging device according to claim 1, wherein the flanging head mounts a third flanging roller which forms another counter pressure roller for at least one of the first flanging roller and the second flanging roller.

5. The flanging device according to claim 1, wherein the fastening apparatus includes at least one mechanical clamp for clamping to the component.

6. The flanging device according to claim 1, wherein the protective structure is formed as a protective strip which follows a flanging edge to be formed.

7. The flanging device according to claim 1, wherein the protective structure comprises at least one spatial marker for positioning in an exact fit relative to a flanging edge to be formed.

8. The flanging device according to claim 7, wherein the marker is a centering element or a stopper element.

9. The flanging device according to claim 1, wherein the protective structure is shaped in a moulding method.

10. The flanging device according to claim 1, wherein the flanging head mounts one of the flanging rollers resiliently yielding.

11. The flanging device according to claim 1, wherein the protective structure protects a viewed area of the component during roll-flanging.

12. The flanging device according to claim 1, wherein the flanging device is a hemming device.

13. The flanging device according to claim 12, wherein the component forms a part of an outer side of a vehicle body, and a rim strip of an inner part of the body is received in a hem slot of the component formed by means of the flanging device, forming a hem connection.

14. The flanging device according to claim 1, wherein the device is used for roll-flanging a rim of a vehicle body or vehicle body part.

15. The flanging device according to claim 1, including:

a) a holder;

b) an equalisation structure which is held by the holder and can be moved relative to the holder in a direction of equalisation; and, c) a damping or restoring apparatus which opposes a movement of the equalisation structure in the direction of equalisation with a damping or restoring force supported on the holder;

wherein the first flanging roller is mounted by the equalisation structure and the second flanging roller is mounted by the equalisation structure and forms a counter pressure roller for the first flanging roller.

16. The flanging device according to claim 15, wherein the holder mounts the equalisation structure such that it can move linearly.

17. The flanging device according to claim 15, wherein the damping or restoring force is generated pneumatically.

18. The flanging device according to claim 1, wherein the flanging head mounts at least two first flanging rollers for partial flanging which can be performed successively and consecutively.

19. The flanging device according to claim 18, wherein per first flanging roller, the flanging head mounts at least one second flanging roller acting as a counter pressure roller.

20. The flanging device according to claim 1, wherein the flanging head mounts at least two first flanging rollers which each co-operate with the same second flanging roller in partial flanging which can be performed successively and consecutively.

21. A method for roll-flanging a component along a flanging edge, using a flanging device according to claim 1, comprising the steps of:

a) positioning the protective structure along the flanging edge relative to the component;

b) rolling the first flanging roller off on a rim strip which extends along one side of the flanging edge and is to be at least partially beaded around the flanging edge; and c) rolling the second flanging roller off on an area of the component which extends along the other side of the flanging edge, the second flanging roller acting as a counter pressure roller for the first flanging roller;

wherein one of the flanging rollers rolls off on a rolling surface formed by the protective structure or on a rolling surface supported by the protective structure.

22. The method according to claim 21, wherein the protective structure abuts a viewed area of the component and forms the rolling surface.

23. The method according to claim 21, wherein the protective structure is inserted into an inner region of the flanging edge and during roll-flanging, abuts an inner side of a viewed area of the component forming the rolling surface.

24. A flanging device for roll-flanging a rim of a component, said flanging device including:

a) a flanging head;

b) a first flanging roller which is mounted by the flanging head and can be rolled off on the rim during roll-flanging; and c) a second flanging roller which is mounted by the flanging head and forms a counter pressure roller for the first flanging roller;

wherein the flanging device includes a stable protective structure which is or can be fastened to the component and forms a rolling surface for one of the flanging rollers or supports a rolling surface, wherein the protective structure includes a fastening anparatus for fastening to the component, and wherein the flanging head mounts a sensing element and the protective structure forms a guiding path for guiding the sensing element, wherein the guiding path is shaped to follow the course of a flanging edge to be formed.

25. A flanging device for roll-flanging a rim of a component, said flanging device including:

a) a flanging head;

b) a first flanging roller which is mounted by the flanging head and can be rolled off on the rim during roll-flanging; and c) a second flanging roller which is mounted by the flanging head and forms a counter pressure roller for the first flanging roller;

wherein the flanging device includes a stable protective structure which is or can be fastened to the component and forms a rolling surface for one of the flanging rollers or supports a rolling surface, wherein the protective structure includes a fastening apparatus for fastening to the component, and wherein a sensor is provided by means of which a distance between the flanging head and at least one of the component and the protective structure can be ascertained during roll-flanging.

26. A flanging device for roll-flanging a rim of a component, said flanging device including:

a) a flanging head;

b) a first flanging roller which is mounted by the flanging head and can be rolled off on the rim during roll-flanging; and c) a second flanging roller which is mounted by the flanging head and forms a counter pressure roller for the first flanging roller;

wherein the flanging device includes a stable protective structure which is or can be fastened to the component and forms a rolling surface for one of the flanging rollers or supports a rolling surface, wherein the protective structure includes a fastening apparatus for fastening to the component, and wherein a 2D sensor is provided by means of which the position of the flanging head relative to the component can be ascertained in a plane of view of the component.

27. A flanging device for roll-flanging a rim of a component, said flanging device including:

a) a flanging head;

b) a first flanging roller which is mounted by the flanging head and can be rolled off on the rim during roll-flanging;

c) a second flanging roller which is mounted by the flanging head and forms a counter pressure roller for the first flanging roller;

d) a holder;

e) an equalisation structure which is held by the holder and can be moved relative to the holder in a direction of equalisation; and, f) a damping or restoring apparatus which opposes a movement of the equalisation structure in the direction of equalisation with a damping or restoring force supported on the holder;

wherein the first flanging roller is mounted by the equalisation structure and the second flanging roller is mounted by the equalisation structure and forms a counter pressure roller for the first flanging roller, wherein the flanging device includes a stable protective structure which is or can be fastened to the component and forms a rolling surface for one of the flanging rollers or supports a rolling surface, wherein the protective structure includes a fastening apparatus for fastening to the component, and wherein the equalisation structure includes a bearer which is held on the holder and can be moved relative to the holder in the direction of equalisation, and an actuating structure which can be moved relative to the bearer, and wherein the first flanging roller is mounted on one of the bearer and the actuating structure, and the second flanging roller is mounted on the other.

28. The flanging device according to claim 27, wherein an actuating apparatus is arranged between the bearer and the actuating structure, by means of which a force acting between the first flanging roller and the second flanging roller during roll-flanging can be set.

29. The flanging device according to claim 28, wherein the actuating apparatus can be arrested.

30. The flanging device according to claim 28, wherein the bearer mounts the actuating structure such that it can move linearly.

31. The flanging device according to claim 28, wherein the bearer and the actuating structure can be moved relative to each other in a direction of equalisation, wherein the direction of equalisation comprises at least a direction component which points at right angles to a flanging edge of the work piece and a rotational axis of the second flanging roller.

32. The flanging device according to claim 28, wherein the actuating apparatus generates an actuating force pneumatically.

33. A flanging device for roll-flanging a rim of a component, said flanging device including:

a) a flanging head;

b) a first flanging roller which is mounted by the flanging head and can be rolled off on the rim during roll-flanging;

c) a second flanging roller which is mounted by the flanging head and forms a counter pressure roller for the first flanging roller;

d) a bearer;

e) an actuating structure which is held such that it can be moved on the bearer; and, f) an actuating apparatus arranged between the bearer and the actuating structure, by means of which a force acting between the first flanging roller and the second flanging roller during roll-flanging can be set;

wherein the flanging device includes a stable protective structure which is or can be fastened to the component and forms a rolling surface for one of the flanging rollers or supports a rolling surface, wherein the protective structure includes a fastening apparatus for fastening to the component and wherein the first flanging roller is mounted by the actuating structure and the second flanging roller is mounted by the bearer and forms a counter pressure roller for the first flanging roller.

* * * * *